US005517915A

United States Patent [19]

Oshino et al.

[11] Patent Number: 5,517,915

[45] Date of Patent: May 21, 1996

[54] THERMAL PRINTER

[75] Inventors: Genzi Oshino; Isamu Suzuki, both of Miyagi, Japan

[73] Assignee: Tohoku Ricoh Co., Ltd., Shibata, Japan

[21] Appl. No.: 285,531

[22] Filed: Aug. 5, 1994

Related U.S. Application Data

[62] Division of Ser. No. 87,383, Jul. 8, 1993, Pat. No. 5,370,049.

[30] Foreign Application Priority Data

Jul. 10, 1992 [JP] Japan ..... 4-184085
Jul. 10, 1992 [JP] Japan ..... 4-184093
Jul. 10, 1992 [JP] Japan ..... 4-184095

[51] Int. Cl.[6] ..... B41F 1/08

[52] U.S. Cl. ..... 101/288; 400/613; 242/578; 242/597.2

[58] Field of Search ..... 101/288, 289, 101/290, 291, 292, 293, 294, 295; 400/613, 613.1, 613.2, 613.3; 242/328, 358.1, 597, 597.1, 597.2, 597.5, 599, 599.3, 599.4, 604, 578, 607, 607.1, 608.6, 609, 609.1

[56] References Cited

U.S. PATENT DOCUMENTS

| | | | |
|---|---|---|---|
| 2,686,953 | 8/1954 | Pike | 242/609.1 X |
| 3,025,016 | 3/1962 | DeBoo | 242/578 |
| 3,245,631 | 4/1966 | Pitts | 242/597.2 X |
| 3,735,941 | 5/1973 | Brown et al. | 242/597.2 |
| 4,002,309 | 1/1977 | Ruiz-Barbotteau | 242/609.1 X |
| 4,027,590 | 6/1977 | Seidl et al. | 400/613 X |
| 4,036,132 | 7/1977 | Ellefson | 101/288 |
| 4,386,860 | 6/1983 | Price et al. | 101/288 X |
| 4,418,618 | 12/1983 | Huggins et al. | 101/288 X |
| 4,724,033 | 2/1988 | Vanderpool et al. | 101/288 X |
| 4,996,539 | 2/1991 | Haraga et al. | 101/288 X |
| 5,238,198 | 8/1993 | Jingu et al. | 400/613 X |

FOREIGN PATENT DOCUMENTS

| | | | |
|---|---|---|---|
| 0052444 | 3/1985 | Japan | 242/578 |

*Primary Examiner*—Christopher A. Bennett
*Attorney, Agent, or Firm*—Armstrong, Westerman, Hattori, McLeland & Naughton

[57] ABSTRACT

In a thermal printer for performing printing on the printing surface of a tag which is drawn out from a tag roll and then held and conveyed by a platen and a line thermal head, the thermal printer comprises a thread sweeping means for sweeping away the threads which get on the printing surface of the tag and a tag guide means disposed downstream the conveying direction of the tag for bringing into contact with the side edge of the tag which is opposite to the other side edge thereof to which the threads are attached so that the threads which get on the printing surface of the tag are swept away by the thread sweeping means and the tag is conveyed in the manner that the threads do not contact the tag guide, which eventually prevents the threads from being caught by parts on the conveying route or prevents the tag from being printed on the printing surface thereof while the threads remain getting on the printing surface. Furthermore, a roll holder for holding the entire tag roll is attached to a detachable roll presser plate facing the threads, thereby preventing the threads from being put between the roll presser plate and the roll holder.

3 Claims, 17 Drawing Sheets

THERMAL PRINTER

This is a division, of application Ser. No. 08/087,383 filed Jul. 8, 1993, now U.S. Pat. No. 5,370,049.

BACKGROUND OF THE INVENTION

1. Field of the Invention

The present invention relates to a thermal printer having a line thermal head, particularly to a thermal printer using a tag provided at one side edge thereof (hereinafter referred to as a tag).

2. Prior Art

FIGS. 21 and 22 show a conventional typical thermal printer capable of performing printing on a tag.

The thermal printer comprises a supporting shaft 1, a collar 2 in which the supporting shaft 1 is slidably rotatably engaged, an innermost roll presser plate 3, a roll holder 4 and a boss 5 which are respectively fixed to central inner and outer surfaces of the innermost roll presser plate 3 wherein central holes of the innermost roll presser plate 3, roll holder 4 and boss 5 are respectively engaged in the collar 2 and the boss 5 is fixed to the collar 2 by way of a screw 6, whereby the innermost roll presser 3 is positioned relative to the collar 2 in the axial direction thereof, i.e., left and right directions in FIG. 21.

A tag roll 7, which is formed by winding a tag 10 around a core 8 in a roll shape, is engaged in the roll holder 4 as illustrated in FIG. 22 and a front side roll presser plate 11 is fixed to the collar 2 by inserting the collar 2 into a hole 11*a* defined at the central portion thereof.

The tag is a type for use in price tags, etc. and has a plurality of threads 9 at one side thereof (hereinafter referred to as threads 9) wherein when it is set on the tag roll, an entire tag roll 7 is pressed by the front side roll presser plate 11 by way of the threads 9 whereby the rear surface 7*a* of the tag roll 7 is pressed against the innermost roll presser 3. At this state, the front side roll presser plate 11 is fixed to the collar 2 by screwing a screw 13 into a boss 12 which is integrated with the front side roll presser plate 11.

Accordingly, the tag roll 7 is turned relative to the supporting shaft 1 together with the roll holder 4, the collar 2, etc. at the state where it is held between the innermost and front side roll presser plates 3 and 11 without unwinding the tag 10.

The tag 10 wound around the tag roll 7 is successively drawn out from one end thereof, as illustrated in FIG. 22, and is conveyed in the direction of the arrow A while it is held by a thermal head 21 and a platen 22.

In the course of conveyance of the tag 10, the tag 10 is guided along a tag guide roller 14 toward the direction of the arrow A and the threads 9 are swept away from a printing surface 10*a* (hereinafter referred to as a printing surface 10*a*) by a thread sweeping brush 15 so that the threads 9 hang down outside the tag 10.

When the hanging threads 9 reach tag guides 17 and 18 capable of positioning the tag in the width direction thereof, the threads 9 get on the corner of the printing surface 10*a*. At this state, a given printing is performed on the printing surface 10*a* at the printing portion while the tag 10 is held by the thermal head 21 and the platen 22 by way of an ink ribbon 19.

The tag guide 17 is fixed while the tag guide 18 is movable and adjustable in the width direction of the tag 10.

However, according to the conventional thermal printer, even if the threads are swept away from the printing surface by the thread sweeping brush, the same threads get on the printing surface again when the tag is guided by the tag guide, which restricts the width direction of the tag, at the both side edges thereof. As a result, the threads are liable to pass through the thermal head and platen at the time of printing, which leads to the deterioration of the printing quality.

Inasmuch as the thread sweeping brush is disposed only at the position adjacent to a tag roll holding device comprising two roll presser plates, etc., if the thread is a type such as a silk thread having a property to jump up, such thread is liable to get on the printing surface before it reaches the thermal head and the platen even if it is swept away by the thread sweeping brush, which causes deterioration of the printing quality when it gets on the printing surface before it reaches the printing position.

Furthermore, since the conventional thermal printer has a structure to hold both side edges of the tag to be conveyed by a pair of tag guides to thereby restrict the width direction of the tag, if the interval between a pair of tag guides is tightly set, the tag and the thread are liable to be damaged due to the strong pressing of both side edges of the tag by a pair of tag guides. If the interval between a pair of tag guides is loosely set, the tag is conveyed while it is positioned on either side of the tag guide, which causes the displacement of the printing position relative to the tag.

Inasmuch as the thread which gets on the printing surface as it is successively drawn out from the tag roll is intended to be swept away from the printing surface by the thread sweeping brush after it passes through the tag guide roller, such thread is liable to become entangled with another thread when the thread is pressed against the printing surface at the time of passing through the tag guide roller or liable to be caught by notches which are formed at equal intervals along both side edges of the tag in the conveying direction thereof, whereby poor conveyance or deterioration of the printing quality may result.

In case of the tag roll holding device which is provided in the conventional thermal printer as illustrated in FIG. 21, when the front side roll presser plate 11 alone is removed and the core 8 of the tag roll 7 is engaged in the roll holder 4 integrated with the innermost roll presser plate 3 which is attached to the body of the tag roll holding device and thereafter the front side roll presser plate 11 is pressed against and fixed to the tag roll 7, the threads 9 on the tag roll 7 positioned immediately above the core 8 get over the core 8 and hang down while the threads 9 on the tag roll 7 positioned under the core 8 hang down so that the threads 9 are positioned under the outer periphery of the tag roll 7 at the distal ends thereof.

Accordingly, when the front side roll presser plate 11 is pressed against and fixed to the tag roll 7 at that state, the threads 9 are crushed so that the thread 9 or the thread 9 and tag 10 are liable to be entangled with one another, whereby the entangled threads or the entangled thread and tag are liable to be caught by the tag roll when the tag is successively drawn from the tag roll, which causes obstacles to the thermal printer.

To solve these problems, it is necessary to set the threads between the innermost and front side presser plates at the state where the threads are lined up to prevent the threads from being entangled with one another or being caught by the notches when the tag is drawn out from the tag roll at the time of setting the tag, which leads to the troublesome handling.

SUMMARY OF THE INVENTION

To solve the aforementioned problems of the conventional thermal printer, it is a first object of the present invention to provide a thermal printer capable of preventing threads from being caught by parts on a conveying route before the thread which is drawn from a tag roll reaches between a thermal head and a platen and also preventing the threads from getting on the printing surface, which eventually prevents the deterioration of the printing quality.

It is a second object of the present invention to provide a thermal printer capable of restricting the tag which is drawn out from the tag roll so as to position the tag correctly, which eventually prevents the displacement of the printing position and also prevents the tag and the thread from being damaged.

It is a third object of the present invention to provide a thermal printer capable of sweeping away the thread which gets on the printing surface of the tag which is drawn out from the tag roll as quickly as possible so as to prevent the threads or the thread and tag from being entangled with one another, or preventing the thread from being caught by parts on the conveying route, or preventing the thread from getting on the printing surface, which eventually prevents the poor conveyance or deterioration of printing quality.

It is a fourth object of the present invention to provide a thermal printer capable of releasing threads from notches formed on both side edges of the tag which is drawn from the tag roll even if the threads are caught by notches.

It is a fifth object of the present invention to provide a thermal printer capable of lining up the threads and easily setting the so lined up threads between two roll presser plates so as to draw out the tag smoothly from the tag roll.

To achieve the above objects, in the thermal printer for performing printing on the printing surface of a tag which is drawn out from a tag roll and then held and conveyed by a platen and a line thermal head, the thermal printer comprises a thread sweeping means for sweeping away the thread which gets on the printing surface and a tag guide means having a guide member which is disposed downstream in the conveying direction of the tag for guiding the tag by contacting the side edge of the tag opposite to the other side edge thereof to which the threads are attached wherein the guide member is movable and freely positioned in the perpendicular direction to cross the conveying direction of the tag at right angles.

The tag guide means may comprise the aforementioned guide member and a guide roller for applying conveying force to the tag in the direction to bring the side edge of the tag, opposite to the side edge to which the threads are attached, into contact with the guide member.

It is more effective to provide a means for sheltering the guide roller away from the conveying surface of the tag.

Furthermore, a second thread sweeping means for sweeping away the thread which gets on the printing surface may be provided on the conveying route of the tag between the tag guide means and a tight holding portion defined between the platen and the thermal head.

It is more effective to provide a means of sheltering the second thread sweeping means away from the conveying surface of the tag.

Furthermore, in the thermal printer having the thread sweeping means and the tag guide means as set forth above, the thread sweeping means comprises thread sweeping members for slidably putting the tag, which is drawn out from the tag roll, therebetween at the upper and lower surfaces thereof and a holding member for movably holding the thread sweeping members following the variation of the roll diameter of the tag roll.

It is more effective in such a thermal printer that the thread sweeping members comprise a pair of confronted rod-shaped members.

Still furthermore, in a thermal printer for setting the tag roll between two roll presser plates wherein a tag is continuously wound around the outer periphery of the core of the tag roll, drawing out the tag from the tag roll, followed by performing the printing on the printing surface of the tag while the tag is held and conveyed by the platen and the line thermal head, a roll holder for holding the entire tag roll by holding the core is attached to the detachable roll presser plate which faces the threads.

It is more effective to form windows on the roll presser plate facing the threads, through which the threads freely run off outside the roll presser plate.

In a thermal printer having the thread sweeping means and the tag guide means, a tag roll is set on and held by two roll presser plates wherein a tag is continuously wound around the outer periphery of core of the tag roll, a roll holder for holding the entire tag roll by holding the core is attached to the detachable roll presser plate which faces the threads.

In the arrangement of the thermal printer as set forth above, the tag is brought into contact with and guided by the guide member of the guide means at the side edge opposite to the other side edge to which the threads are attached so that the thread which is swept away from the printing surface by the thread sweeping means is conveyed as it is to the tight holding portion defined between the platen and the thermal head without contacting the guide member.

Therefore, it is possible to prevent the thread from being caught by the parts on the conveying route or prevent the thread from getting on the printing surface, which eventually prevents the deterioration of the printing quality.

If the tag guide means comprises the aforementioned guide member and the guide roller for applying conveying force to the tag in the direction to bring the side edge of the tag, opposite to the side edge to which the threads are attached, into contact with the guide member, the tag is conveyed on the conveying route while it is pressed against the guide member by the guide roller so that the tag, which is drawn out from the tag roll, can be restricted to positioned correctly for thereby preventing the displacement of the printing position and for preventing the tag or the thread from being damaged.

If the means for sheltering the guide roller away from the conveying surface of the tag is provided, the guide roller can be temporarily sheltered away from the conveying surface of the tag so that the tag can be set with ease.

If the second thread sweeping means is provided on the conveying route of the tag between the tag guide means and the tight holding portion defined between the platen and the thermal head, the thread once swept away from the printing surface can be swept away again from the printing surface even if the thread gets on again the printing surface.

If the means for sheltering the second thread sweeping means away from the conveying route of the tag is provided, the second thread sweeping g means can be temporarily sheltered away from the conveying surface of the tag so that the tag can be set with ease.

If the thread sweeping means comprises the thread sweeping members for slidably putting the tag therebetween at the upper and lower surfaces thereof and the holding member for movably holding the thread sweeping member following the variation of the roll diameter of the tag roll, the thread sweeping members move following the variation of the roll diameter of the tag roll even if the thread sweeping means is disposed close to the tag roll so as to slidably put the tab between the thread sweeping members at the upper and lower surfaces thereof, they can always sweep away the threads on the printing surface even if the roll diameter of the tag roll is diminished when used.

If the thread sweeping members are approached to the tag roll as close as possible, the thread sweeping means can sweep away the threads from the printing surface while releasing the threads from the notches even if the threads of the tag which is drawn out from the tag roll are caught by the notches formed on both side edges of the tag.

If the thread sweeping members are formed by a pair of confronting rod-shaped members, they can be varied in the shape thereof for sweeping away the threads.

if the roll holder for holding the entire tag roll by holding the core around which the tags are wound is attached to the detachable roll presser plate which faces the threads, the threads are prevented from being held by the roll presser plate and the roll holder even if the detachable roll presser plate alone is detached from the body of the roll holder and replaced by the tag roll since the roll presser plate is integrated with the roll holder for holding the tag roll so that the threads can be easily lined up, which prevents the thread from being entangled or being caught by the notches so that the tag can be drawn out smoothly from the tag roll.

If the windows are formed on the roll presser plate facing the threads, through which the threads freely run off outside the roll presser plate, the threads protrude from the windows and run off outside the roll presser plate when the tag is set on the tag roll so that the tag can be more smoothly drawn out from the tag roll to such an extent that the threads are not pressed by the roll presser plate.

In a thermal printer having the thread sweeping means and the tag guide means, if the tag roll is set on and held by two roll presser plates wherein a tag is continuously wound around the outer periphery of the core of the tag roll and a roll holder for holding the entire tag roll by holding the core is attached to the detachable roll presser plate which faces the threads, it is possible to prevent the thread from being entangled with other threads or from being caught by the notches so that the tag can be smoothly drawn out from the tag roll and also prevent the threads from being caught by the parts on the conveying route or prevent the deterioration of the printing which is caused when the threads get on the printing surface.

The above and other objects, features and advantages of the invention will be apparent from the following detailed description which is to be read in conjunction with the accompanying drawings.

BRIEF DESCRIPTION OF THE DRAWINGS

FIGS. 14 to 19 are views showing a thermal printer according to a third embodiment, wherein FIG. 14 is a perspective view showing the first sweeping means disposed adjacent to a tag roll;

FIG. 15 is a view showing the state where the thread is caught by a notch of the tag;

FIG. 16 is a plan view explaining the state where the thread caught by the notch of the tag is released by the first sweeping means;

FIG. 17 is a perspective view showing the state where the first thread sweeping means is set on an outer winding tag roll according to a first modification of the third embodiment;

FIG. 18 is a perspective view showing the state where thread sweeping members release the threads which are caught by the notch of the tag even if the roll diameter of the tag roll is diminished according to a second modification of the third embodiment;

FIG. 19 is a view showing the state where the thread in FIG. 17 is caught by the notch of the tag;

DETAILED DESCRIPTION OF THE PREFERRED EMBODIMENT

First Embodiment (FIGS. 1 to 10)

Figure 1:
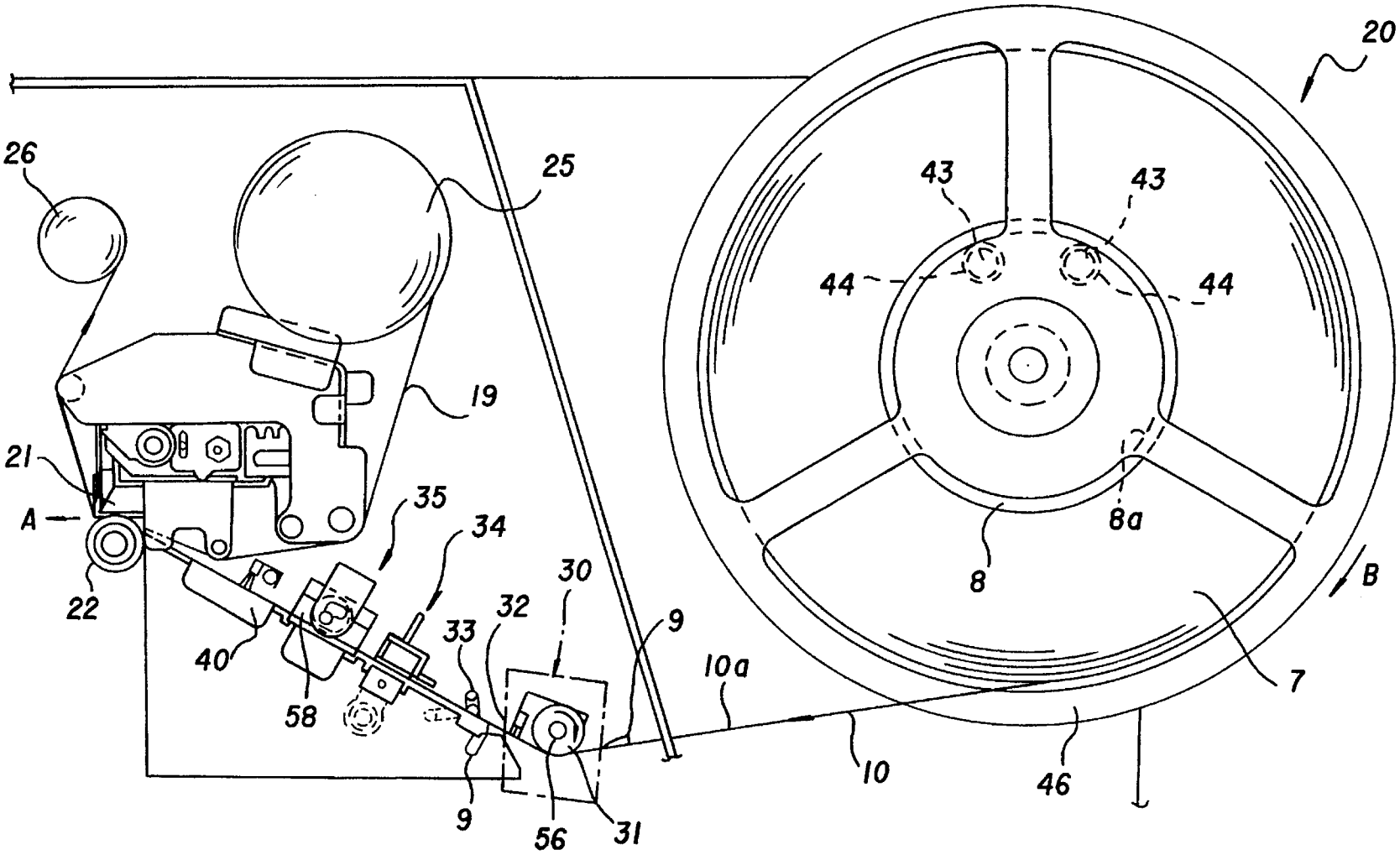
FIG. 1 is a front view showing an entire arrangement of a thermal printer according to a first embodiment of the present invention.

A thermal printer according to the first embodiment of the present invention will be described hereinafter with reference to FIGS. 1 to 10.

The thermal printer comprises a tag roll holding device 20, a tag roll 7 which is held by the tag roll holding device 20 and is turnable in the direction of the arrow B, a platen 22, a line thermal head 21, a ribbon feeding reel 25 and a ribbon winding reel 26 for winding an ink ribbon 19 wherein a tag 10 is successively drawn out from one end of the tag roll 7 and is held and conveyed by the platen 22 and the thermal head 21 in the direction of arrow A and then subjected to printing on the printing surface thereof, by way of the ink ribbon 19 which is fed from the ribbon supply reel 25 to the ribbon winding reel 26.

Figure 2:
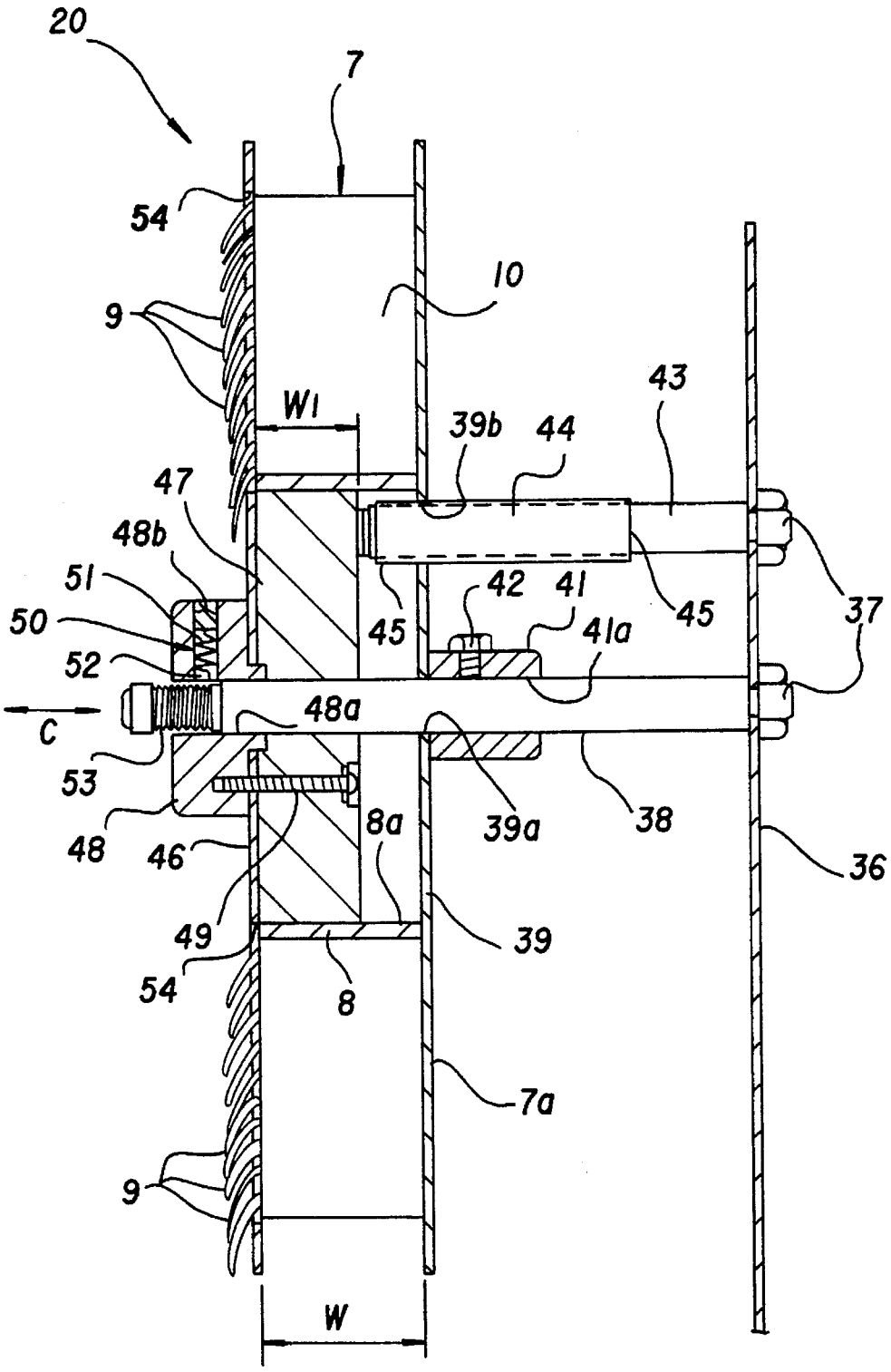
FIG. 2 is a cross-sectional side view of a tag roll holding device of the thermal printer of FIG. 1.
Figure 3:
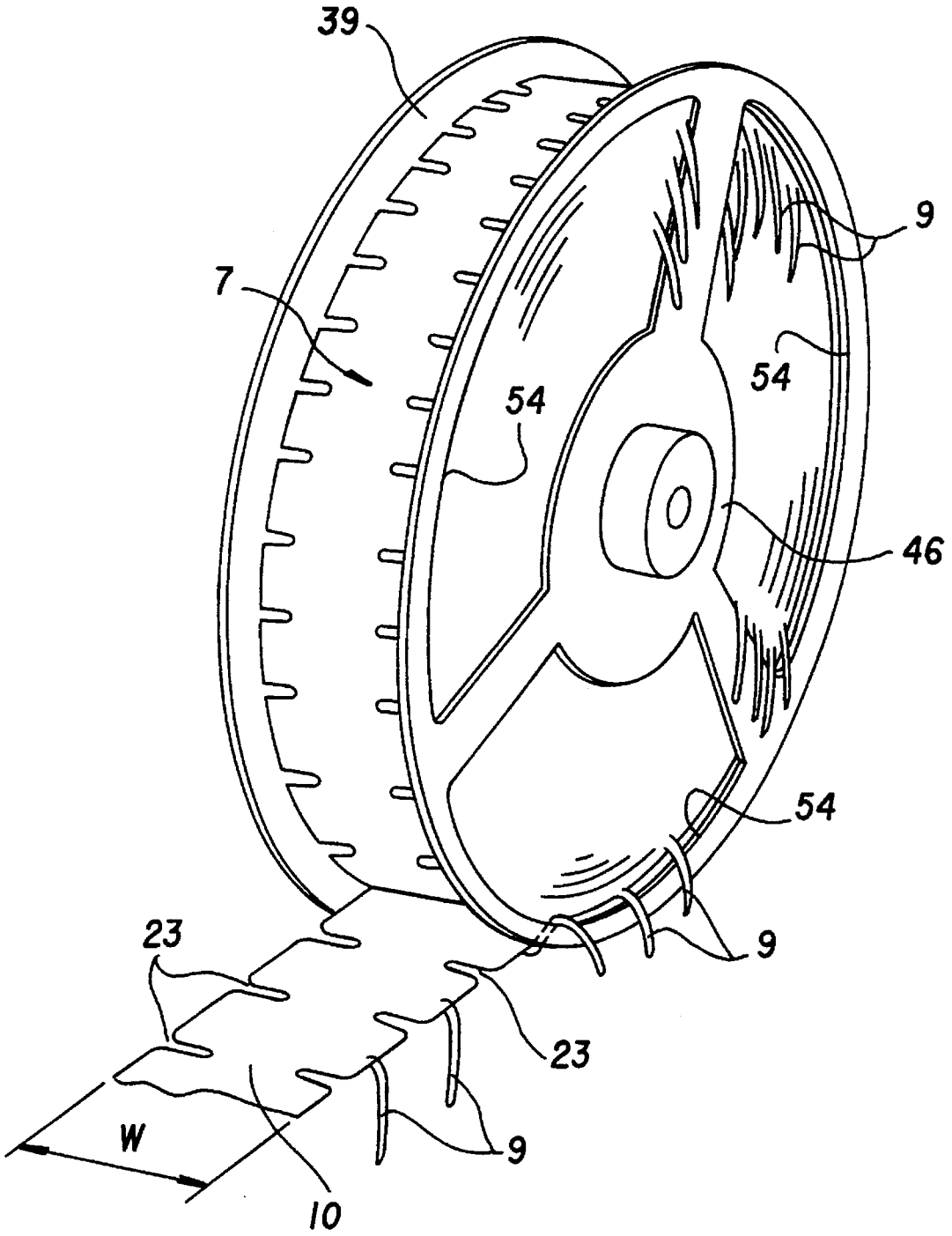
FIG. 3 is a perspective view of a tag roll which is set on the tag roll holding device.
Figure 4:
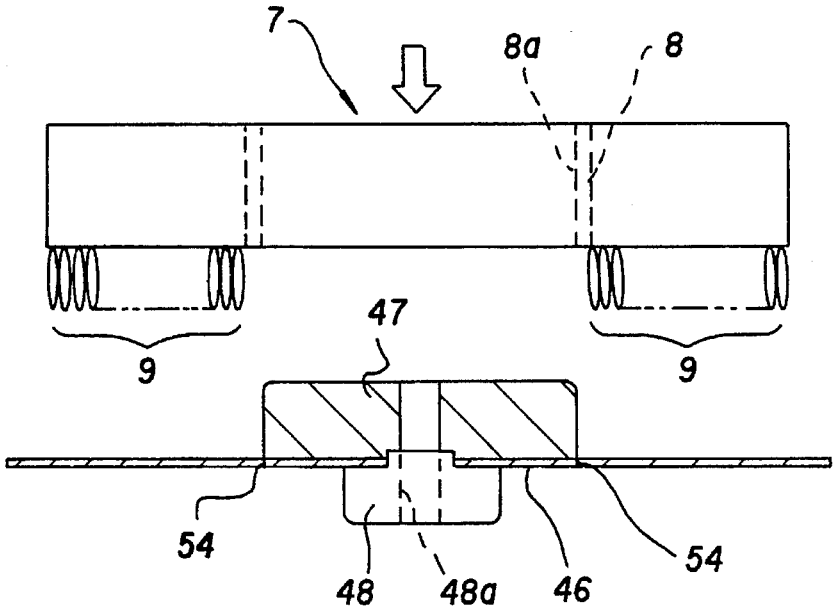
FIG. 4 is a schematic view explaining the steps of setting the tag roll on the tag roll holding device.

The tag 10 wound around the tag roll 7 has a plurality of notches 23 at both side edges thereof at equal intervals and threads 9 at one side edge thereof for use in price tags, etc. as shown in FIG. 3 and it is wound continuously around the outer periphery of a ring shaped core 8 of the tag roll 7 as shown in FIG. 2.

As illustrated in FIG. 1, there are provided a first thread sweeping means 30 on a conveying route between the tag roll holding device 20 and the platen 22 wherein the first thread sweeping means 30 comprises a guide roller 31 which is turnable in the direction of the arrow in FIG. 1 and a first brush 32 for sweeping away the threads 9 which get on the printing surface 10*a*.

Furthermore, there are provided a tag end switch 33 disposed downstream the first thread sweeping means 30 for detecting the presence of the tag 10 and a notch detecting sensor 34 disposed downstream the tag end switch 33 on the conveying route for detecting the presence of the notch 23 (FIG. 3).

Still furthermore, there is provided a tag guide means 35 disposed downstream the notch detecting sensor 34 operative to move and position a tag guide plate 58 in the direction to cross the conveying direction of the tag 10 at right angles, which will be described later more in detail. The tag guide plate 58 serves as a guide member for guiding the tag 10 by coming into contact with the side edge opposite to the side edge to which the threads 9 are attached.

There is disposed a second thread sweeping means 40 downstream the tag guide means 35 for sweeping away the threads 9 which get on the printing surface 10*a*.

A central hole 39*a* of a discoidal innermost roll presser plate 39 (refer to FIG. 3) and a slide hole 41*a* of a boss 41 integrally fixed to the central portion of the right side surface of the innermost presser plate 39 in FIG. 2 are respectively engaged in a supporting shaft 38 fixed horizontally to a printer side plate 36 by a nut 37 at one end thereof so as to be slidable in the arrow C as illustrated in FIG. 2. The roll presser plate 39 and the boss 41 are fixed to the supporting shaft 38 by screwing a thumb screw 42 into a screw hole formed radially on the boss 41 whereby the innermost roller presser plate 39 is positioned relative to the supporting shaft 38 in the axial direction thereof.

Receiving shafts 43, 43 (refer also to FIG. 1) are disposed over the position where the supporting shaft 38 is fixed to the printer side plate 36 and spaced at the same height and fixed to the printer side plate 36 by nuts 37 and 37. Collars 44 and 44 are rotatably engaged in the receiving shafts 43 and 43 at the front portions thereof and slip preventing E-rings 45 and 45 defined at both ends of the collars 44 and 44 in the axial direction thereof are retained by grooves defined on the receiving shafts 43 and 43 to prevent the collars 44 and 44 from slipping out of position in the axial direction of the receiving shafts 43 and 43.

There are formed holes 39*b* on the innermost roll presser plate 39 corresponding to the collars 44 and 44 wherein diameters of the holes 39*b* are slightly greater than those of the collars 44 and 44 so that the collars 44 and 44 penetrate the holes 39*b* with remaining slight gaps therebetween and protrude from the left side surface of the innermost roll presser plate 39 at the tip end sides thereof as illustrated in FIG. 2.

A front side roll presser plate 46 which is discoidal corresponding to the innermost roll presser plate 39 is rotatably engaged in the supporting shaft 38 by way of a roll holder 47 which is integrally fixed to the inner surface of the front side roll presser plate 46.

A thumb 48 is integrally fixed to the central outside portion of the front side roll presser plate 46 by a screw 49 which penetrates the holder 47 whereby the front side presser plate 46, the roll holder 47 and the thumb 48 are integrated with one another.

Accordingly, the roll holder 47 can hold the entire tag roll 7 by engaging the central hole 8*a* of the core 8 of the tag roll 7 into the roll holder 47 at the outer periphery thereof while the roll holder 47 is integrated with the front side roll presser plate 46 facing the threads 9.

There is formed a through hole 48*b* radially on the thumb 48 integrated with the front side roll presser plate 46 wherein the through hole 48*b* extends from the outer periphery of the thumb 48 to the central hole 48*a*. There is formed a plunger 50 in the through hole 48*b* comprising a spring 51, a rigid ball 52 fixed to the lower end of the spring 51 wherein the rigid ball 52 is always urged toward the central hole 48*a* (downward in FIG. 2).

Accordingly, when the front side roll presser plate 46 is moved to the given position by engaging the central hole 48*a* of the thumb 48 into the supporting shaft 38, the rigid ball 52 of the plunger 50 engages with a plurality of V-shaped ring grooves 53 defined at equal intervals at the tip end side of the supporting shaft 38 for thereby positioning the presser plate 46 in the axial direction thereof.

There are defined three large windows 54 on the front side roll presser plate 46 facing the threads 9 through which the threads freely run off outside the front side roll presser plate 46 as illustrated in FIG. 3.

The tag roll 7 is set on the tag roll holding device 20 by placing the front side roll presser plate 46 horizontally in the manner that the thumb 48 is positioned downward, followed by positioning the tag roll 7 in the manner that the threads 9 hang down and by engaging the inner peripheral surface 8*a* of the core 8 into the roll holder 47 which is fixed to the front side roll presser plate 46.

At this stage, since there are formed three large windows 54 on the front side roll presser plate 46 as illustrated in FIG. 3, the threads 9 of the tag 10 protrude outside the front side roll presser plate 46 (lower side of in FIG. 4) from each window 54.

Successively, the front side roll presser plate 46 on which the tag roll 7 is set is raised perpendicularly and the central hole 48*a* of the thumb 48 is inserted into the supporting shaft 38 as illustrated in FIG. 2, thereafter the rear surface 7*a* of the tag roll 7 is pushed against the innermost roll presser plate 39 until the former brings into contact with the latter.

At this state, the rigid ball 52 of the plunger 50 which is integrated with the thumb 48 is retained by the V-shaped ring grooves 53 which are formed at the tip end side of the supporting shaft 38 so that the front side roll presser plate 46 is positioned whereby the tag setting or mounting of the roll on the tag roll holding device 20 is completed.

Since the roll holder 47 for holding the tag roll 7 is integrally fixed to the front side roll presser plate 46 which faces the threads 9, the threads 9 are not likely to be put between the front side roll presser plate 46 and the roll holder 47 even if the tag roll 7 is set on the tag roll holding device 20 while the innermost roll presser plate 39 is left as it is on the tag roll holding device 20 with removing the front side roll presser plate 46 along from the tag roll holding device 20 due to the integration of the front side roll presser plate 46 with the roll holder 47.

Accordingly, the tag 10 can be smoothly drawn out from the tag roll 7 since the thread 9 is neither entangled with another thread nor caught by the notch 23 (refer to FIG. 3) of the tag 10.

Furthermore, since the front side roll presser plate 46 facing the threads 9 has three large windows 54, the threads 9 protrude form the windows 54 toward the outside of the front side roll presser plate 46 and remain free, as illustrated in FIG. 3, when the tag 10 is set on the tag roll 7 so that the threads 9 are not pressed by the front side roll presser plate 46, whereby the tag 10 can be smoothly drawn out from the tag roll 7. Still furthermore, the tag roll 7 is held by the tag roll holding device 20 when the inner peripheral surface 8*a* of the core 8 is engaged into the outer peripheral portion of the roll holder 47 and when the inner peripheral surface 8*a* of the core 8 is placed on the collars 44 and 44 which are respectively rotatably engaged in the outer peripheries of the receiving shafts 43 and 43 as illustrated in FIG. 1.

Accordingly, even if the width W of the tag 10 is too wide compared with the width W1 of the roll holder 47 as illustrated in FIG. 2, the inner peripheral surface 8*a* of the core 8 around which the tag 10 is wound (the width corresponding to the width W) is placed on the collars 44 and 44 so that the setting position of the tag 7 does not incline to such an extent to bring about the inconvenience.

Figure 5:
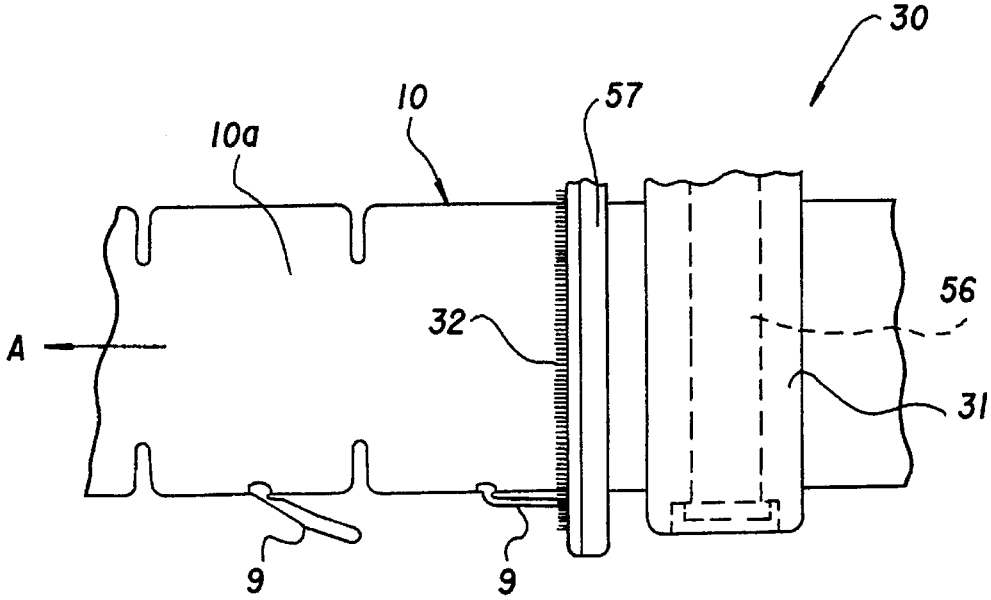
FIG. 5 is a plan view showing a first thread sweeping means and a tag which are respectively provided in the thermal printer of FIG. 1.

The first thread sweeping means 30 as illustrated in FIG. 1 comprises the guide roller 31 which is rotatably supported by a guide shaft 56 which is horizontally attached to the printer side plate 36 (refer to FIG. 2) and the first brush 32 which is disposed long in the width direction of the tag 10 crossing the conveying direction of the tag at right angles as shown in FIG. 5 by the arrow A and is fixedly held by a holding portion 57.

The tip end of the first brush 32 is positioned to contact a conveying line which is formed by linearly connecting the position where the printing surface 10*a* of the tag 10 which is drawn out from the tag roll 7 contacts the lower portion of the guide roller 31 and the position where the tip end of the tag 10 is held by the thermal head 21 and the platen 22.

Figure 6A:
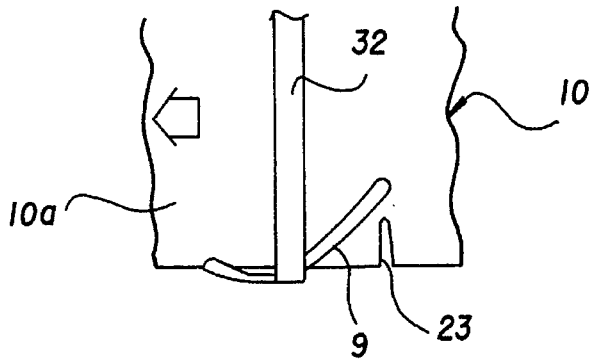
FIGS. 6(A), 6(B), and 6(C) are plan views respectively showing each stage of sweeping operation of threads which get the printing surface by the first thread sweeping means.
Figure 6B:
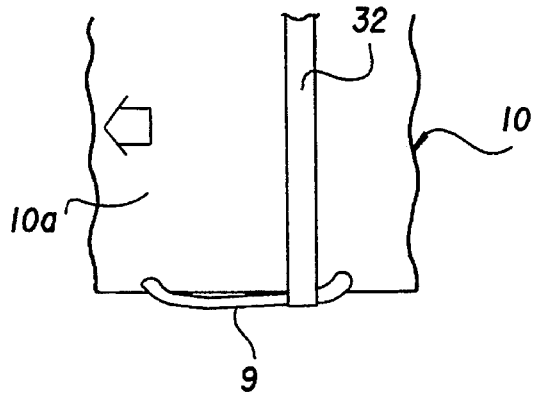
Figure 6C:
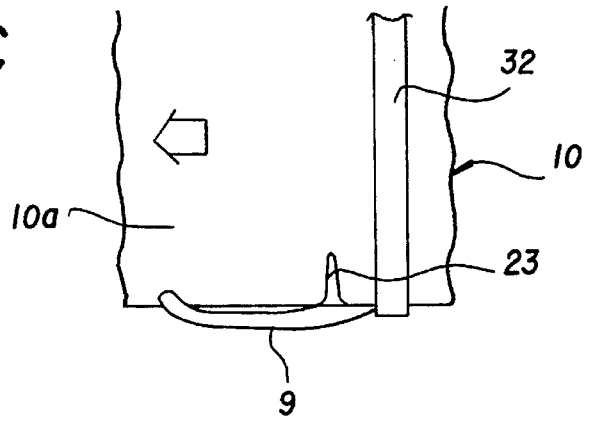

Even if the tag 10 reaches the first thread sweeping means 30 with the thread 9 getting on the printing surface 10*a* of the tag 10 which is drawn out from the tag roll 7 as illustrated in FIG. 6(A), the thread 9 is swept away when the tag 10 passes through the first brush 32, as illustrated in FIG. 6(B) so that it hangs down outside the tag 10 after the tag 10 passed through the first brush 32.

The tag guide means 35 and the second thread sweeping means 40 will be described more in detail with reference to FIGS. 7 and 8.

The tag guide means 35 comprises a tag guide plate 58 and a tag presser roller 67, etc. serving as a guide roller for applying conveying force to the tag in the direction to bring the innermost end surface (side edge) of the tag 10 on which the threads 9 are not attached into contact with the tag guide plate 58.

The tag guide plate 58 comprises a tag receiving portion 58*a* formed by bending a plate member into an L-shape, two guide pins 59 and 59 disposed under and fixed at spaced locations to the rear surface (lower surface) of the tag receiving portion 58*a* and a base 61 having a guide groove 61*a* which is formed on a base 61 in the width direction of the tag crossing the conveying direction of the tag 10 at right angles and in which the guide pins 59 and 59 are movably engaged.

A guide port 62*a*, which is formed in the center of a presser plate 62 having holding slide sheets 63 and 63 bonded on the upper surface thereof, is engaged in the guide pins 59 and 59 and presser springs 64 and 64 having the diameters which are greater than the width of the groove of the guide part 62*a* are inserted into the guide pins 59 and 59 which protrude downward from the presser plate 62.

E-rings 65 and 65 are disposed under the presser springs 64 and 64 and engaged in annular grooves defined on the lower end portions of the guide pins 59 and 59 so as to be attached to the guide pins 59 and 59 whereby the holding slide sheet 63 is pressed against the lower surface of the base 61 owing to the resiliency of the springs 64 and 64 so that the tag guide plate 58 is held by a given holding force and can be movable along the guide groove 61*a*.

A U-shaped shaft guide plate 66 is integrally fixed to the tag guide plate 58 and has an inverse L-shaped guide port 66*b* at one side surface 66*a* thereof. There is formed a guide port on the side surface of the tag guide plate 58 (which is not seen in FIG. 7) corresponding to the guide port 66*a* and a guide shaft 68, which is rotatably engaged in the tag presser roller 67, is engaged in the guide ports.

There guide shaft 68 is supported by a U-shaped holder 69 which surrounds the tag presser roller 67 at the upper and both side surfaces thereof. A compression spring 71 is disposed between the upper surface of the holder 69 and the inner surface of the shaft guide plate 66 corresponding thereto. Accordingly, the tag presser roller 67 is pressed, at a given pressing force owing to the resiliency of the compression spring 71, against the tag receiving portion 58*a* of the tag guide plate 58 by way of the holder 69. Accordingly, the tag 10 can be held between the tag presser roller 67 and the tag receiving portion 58*a*.

The guide port 66*b* of the shaft guide plate 66 for supporting a half of the guide shaft 68 has an inverse L-shape. When the tag presser roller 67 is positioned to put the tag 10 between itself and the tag receiving portion 58*a*, the guide shaft 68 must be positioned at the lower end of the guide port 66*b* so as to set the tag presser roller 67 at the operating position whereby the tag 10 can be pressed between the tag presser roller 67 and the tag receiving portion 58*a*.

Figure 7:
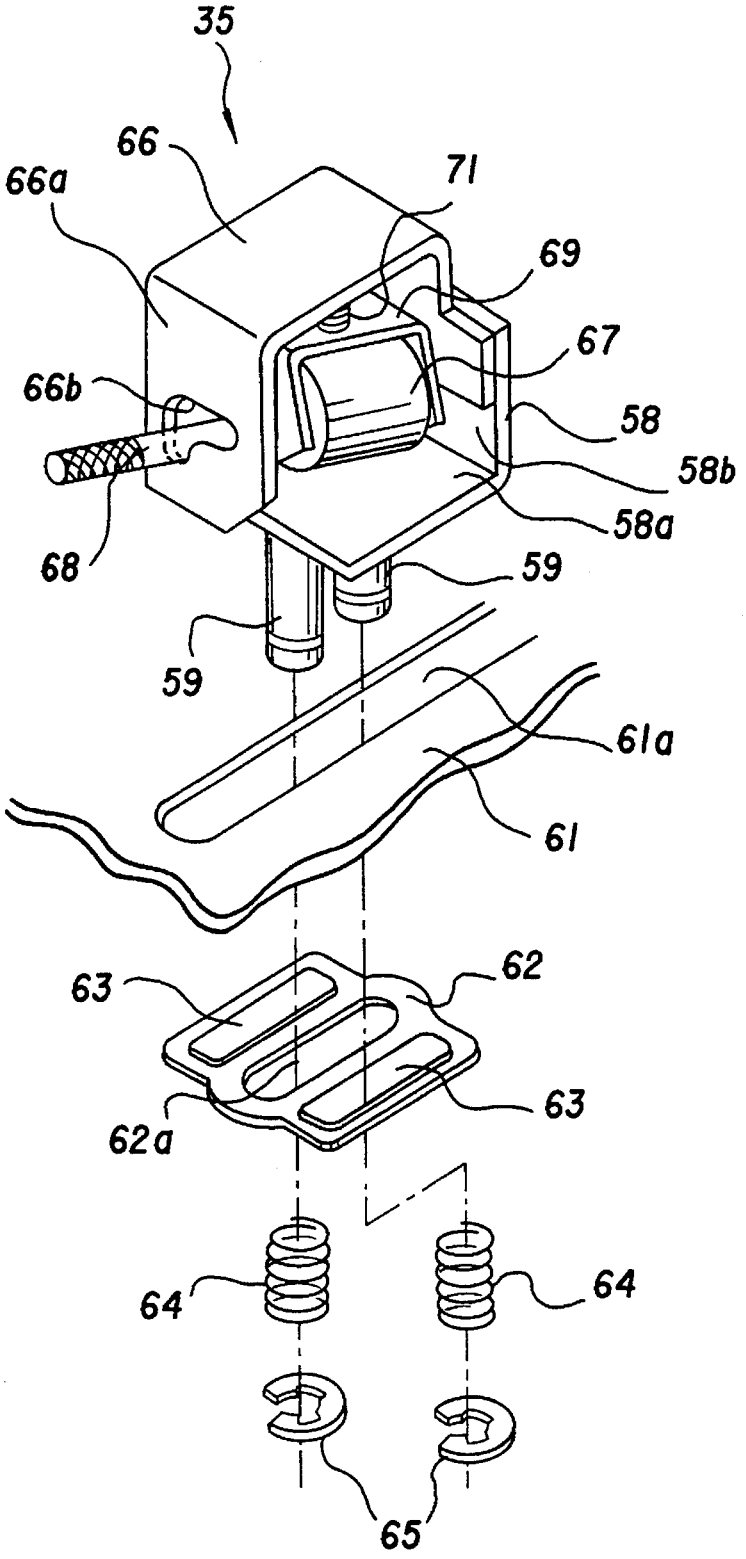
FIG. 7 in an exploded perspective view of a tag guide means provided in the thermal printer of FIG. 1.

Whereupon, when the tag 10 is set between the tag presser roller 67 and the tag receiving portion 58*a*, the guide shaft 68 is positioned at the sheltering position which appears at upper right end in FIG. 7, whereby the tag 10 can be easily set in a gap defined between the tag presser roller 67 and the tag receiving portion 58*a*. In such a manner, the thermal printer is provided with a means for sheltering the tag presser roller 67 away from the tag receiving portion 58*a* serving as the tag conveying surface.

Figure 8A:
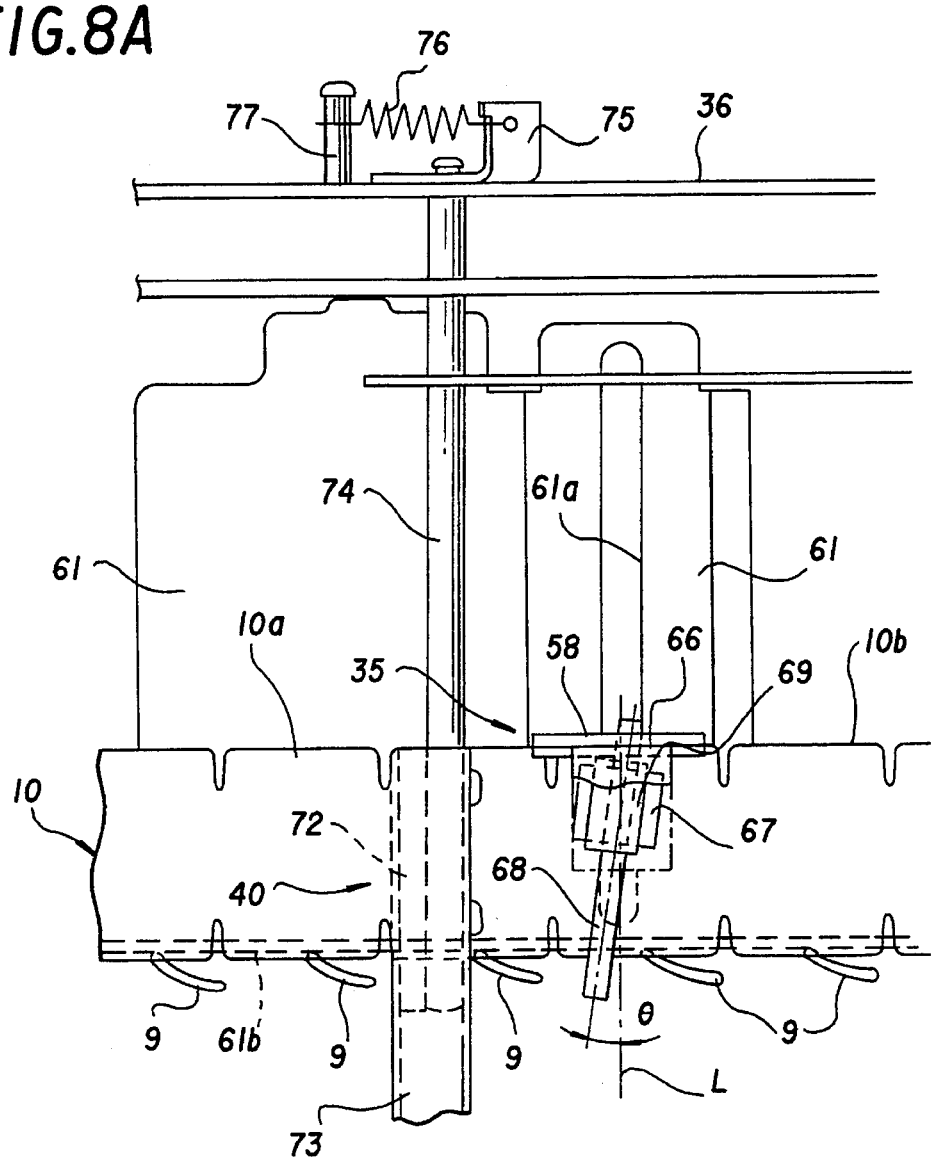
FIG. 8(A) is a front views showing the tag guide means, a second thread sweeping means and the peripheral portions thereof

The guide shaft 68 is set to incline by the angle 0 relative to the line L which crosses the conveying direction of the tag at right angles as shown in FIG. 8(A) when the tag presser roller 67 is positioned at the operating position where the tag 10 can be held between the tag presser roller 67 and the tag receiving portion 58*a*.

Figure 9A:
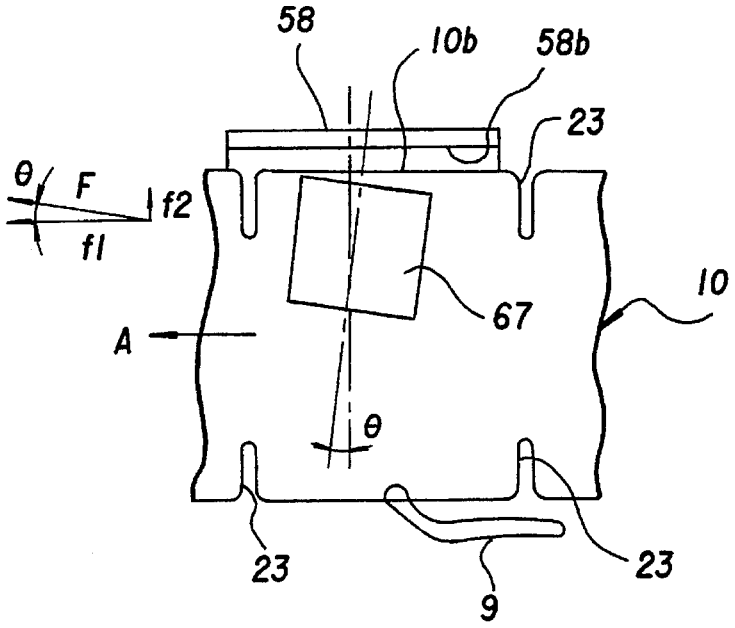
FIGS. 9(A) and 9(B) are plan views explaining each stage of conveyance of the tag wherein an innermost edge surface of the tag is pressed against a tag guide plate by the tag guide means.
Figure 9B:
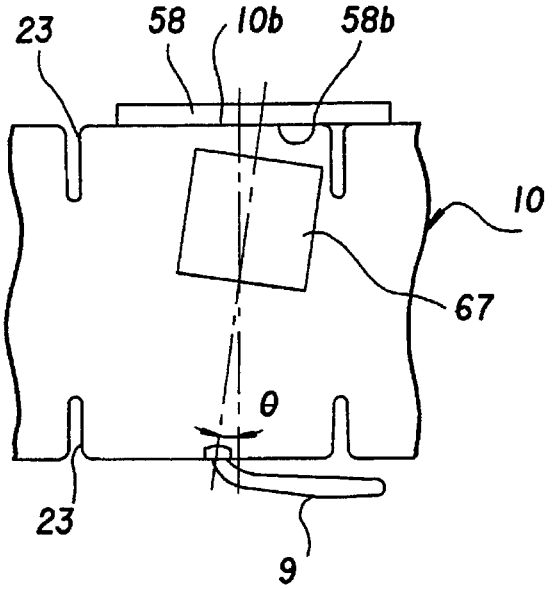

Accordingly, when the tag 10 is held and conveyed in the direction of the arrow A as illustrated in FIG. 9(A) by the thermal head 21 and the platen 22 (refer to FIG. 1), a component force f2 is applied to the tag 10 for pressing the innermost edge surface 10*b* thereof against the tag guide plate 58 owing to the function of the tag presser roller 67 so that the tag 10 is pressed against the tag guide plate 58 owing to the component force f2 while it is conveyed in the direction of the arrow A as illustrated in FIG. 9(B).

Since the resiliency of the presser springs 64 and 64 and the coefficient of friction of the slide sheets 63 are set in the manner that the holding force of the tag guide plate 58 relative to the base 61 (FIG. 7) is greater than the component force f2, the tag guide plate 58 does not move even if the component force is applied to the tag guide plate 58 so that the tag guide plate 58 can restrict the positioning of the tag 10 by aligning the innermost edge surface 10*a* of the tag 10 with the guide surface 58*b* of the tag guide plate 58.

Figure 8B:
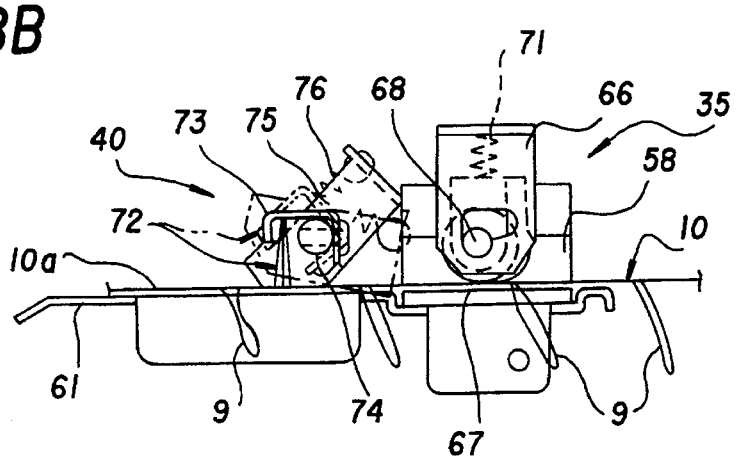
FIG. 8(B) is a plan view of FIG. 8(A)

The second thread sweeping means 40 has a second brush 72 which is movable to a thread sweeping position which contacts the tag conveying surface as illustrated in a solid line of FIG. 8(B) and to a sheltering position which is away from the tag conveying surface as illustrated in an imaginary line of FIG. 8(B).

The second brush 72 is fixed to a brush holding bracket 73 by a screw wherein the latter crosses the conveying direction of the tag 10 at right angles and is long in the width direction of the tag and is fixed to a second brush shaft 74 as illustrated in FIG. 8(A).

The second brush shaft 74 is rotatably attached to the printer body and one end of the second brush shaft 74 opposite to the brush holding bracket 73 penetrates the printer side plate and protrudes above the printer side plate 36 where a positioning bracket 75 is integrally fixed to the other end of the second brush shaft 74 as illustrated in FIG. 8(A).

A tension spring 76 is attached to the positioning bracket 75 at one end thereof and to the printer side plate 36 at the other end thereof by way of a fixed pin 77 wherein the positioning bracket 75 is tensioned and urged by the resiliency of the tension spring 76.

The second brush 72 is movable to the thread sweeping position as illustrated in the solid line and to the sheltering position as illustrated in the imaginary line of FIG. 8(B) owing to the resiliency of the tension spring 76 and a stopper, not shown, fixed to the printer side plate 36 for bringing into contact with the positioning bracket 75 so as to restrict the positioning of the second brush 72.

Accordingly, when the tag 10 is to be set, the second brush 72 is moved to the sheltering position by the means composed of the tension spring 76, etc. for moving the second brush 72 away from the tag conveying surface so as to shelter the second brush 72, thereby defining a gag between the tip end of the second brush 72 and the printing surface 10*a* (upper surface) of the tag 10 whereby the tag 10 can be easily set in the gap.

The second brush 72 is very effective if the threads 10 are formed of light threads such as silk threads. That is, if the light threads like silk threads are used, the threads 9 which are once swept away from the printing surface 10*a* by the first brush 32 (FIG. 1) frequently jump on the printing surface 10*a*. In such a case, the second brush 72 sweeps away the light threads 9 again which get on the printing surface 10*a*, thereby preventing the threads 9 from being held by the tight holding portion defined between the thermal head and the platen.

Figure 10:
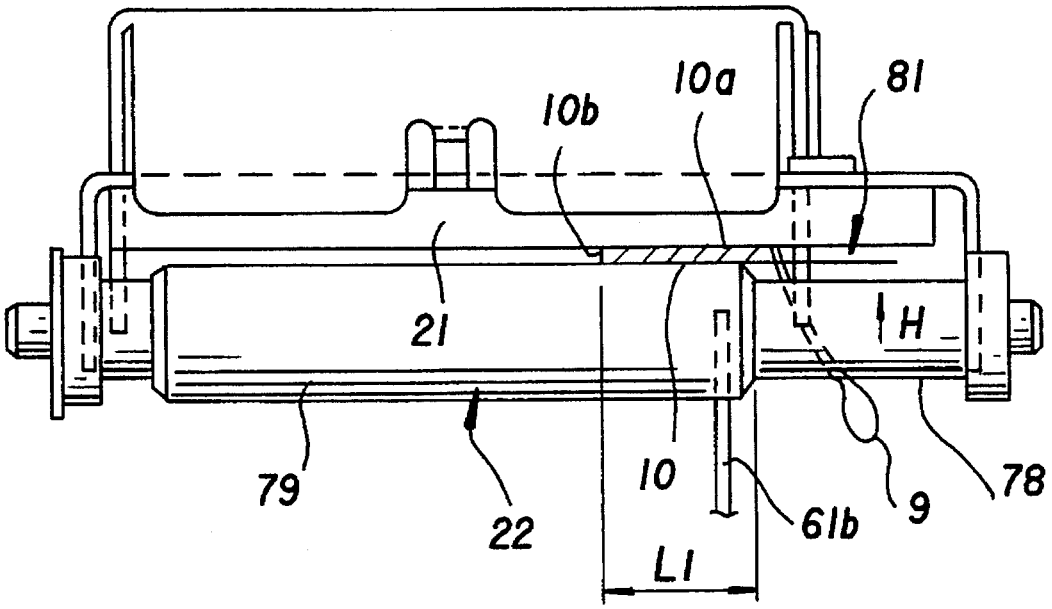
FIG. 10 is a left side view showing the state where the tag is held and conveyed by a thermal head and a platen which are respectively provided in the thermal printer of FIG. 1.

In case of performing the printing on the tag, the tag guide plate 58 is set in the manner that the hanging threads 9 are positioned in front of the front side wall portion 61*b* of the base 61 (lower side in FIG. 8(A) and the innermost roll presser plate 39 of the tag roll holding device 20 (FIG. 2) is also set at the same time. With such a setting, the threads 9 which are swept away from the printing surface 10*a* by the first brush 32 are conveyed to the tight holding portion defined between the thermal head 21 and the platen 22 (FIG. 1) along the front side wall portion 61*b* while they hang down outside the front side wall portion 61*b* as illustrated in FIG. 10. Accordingly, since the threads 9 remained hanging until they reach the tight holding portion defined between the thermal head 21 and the platen 22, the threads 9 are prevented from being caught by the tag end switch 33 or the notch detecting sensor 34 or from being passed through the tight holding portion defined between the thermal head 21 and the platen 22. As a result, it is possible to prevent certainly the poor conveyance of the tag 10 which occurred when the threads 9 are caught by the notches or the parts on the conveying route or the deterioration of the printing quality which occurred when the printing is performed while the threads 9 get on the printing surface 10*a*.

The platen 22 comprises a core metal 78 and a rubber roller 79 as illustrated in FIG. 10. The tag 10 is held by the rubber roller portion 79 and the thermal head 21 by way of the ink ribbon 19 (refer to FIG. 1). At that time, it is necessary to define a difference H in level between the rubber roller portion 79 and the core metal 78 and also necessary to permit the tag 10 to pass through a difference 81 between the rubber roller portion 79 and the thermal head 21 wherein the difference 81 extends in the axial direction to the prevent the threads 9 from being passed through the rubber roller portion 79 and the thermal head 21.

For this purpose, a distance L1 defined between one end of the rubber roller portion 79 and the innermost edge surface 10*b* of the tag 10 (also refer to FIG. 8) must be always constant and the tag 10 must be conveyed while the threads 9 thereof do not get on the printing surface 10*a* thereof. The innermost roll presser plate 39 as explained with reference to FIG. 2 and the tag guide means 35 as explained with reference to FIG. 8 function properly so as to keep the distance L1 constant and the first and second thread sweeping means 30 and 40 function properly so as to prevent the threads 9 from getting on the printing surface 10*a*.

Figure 11:
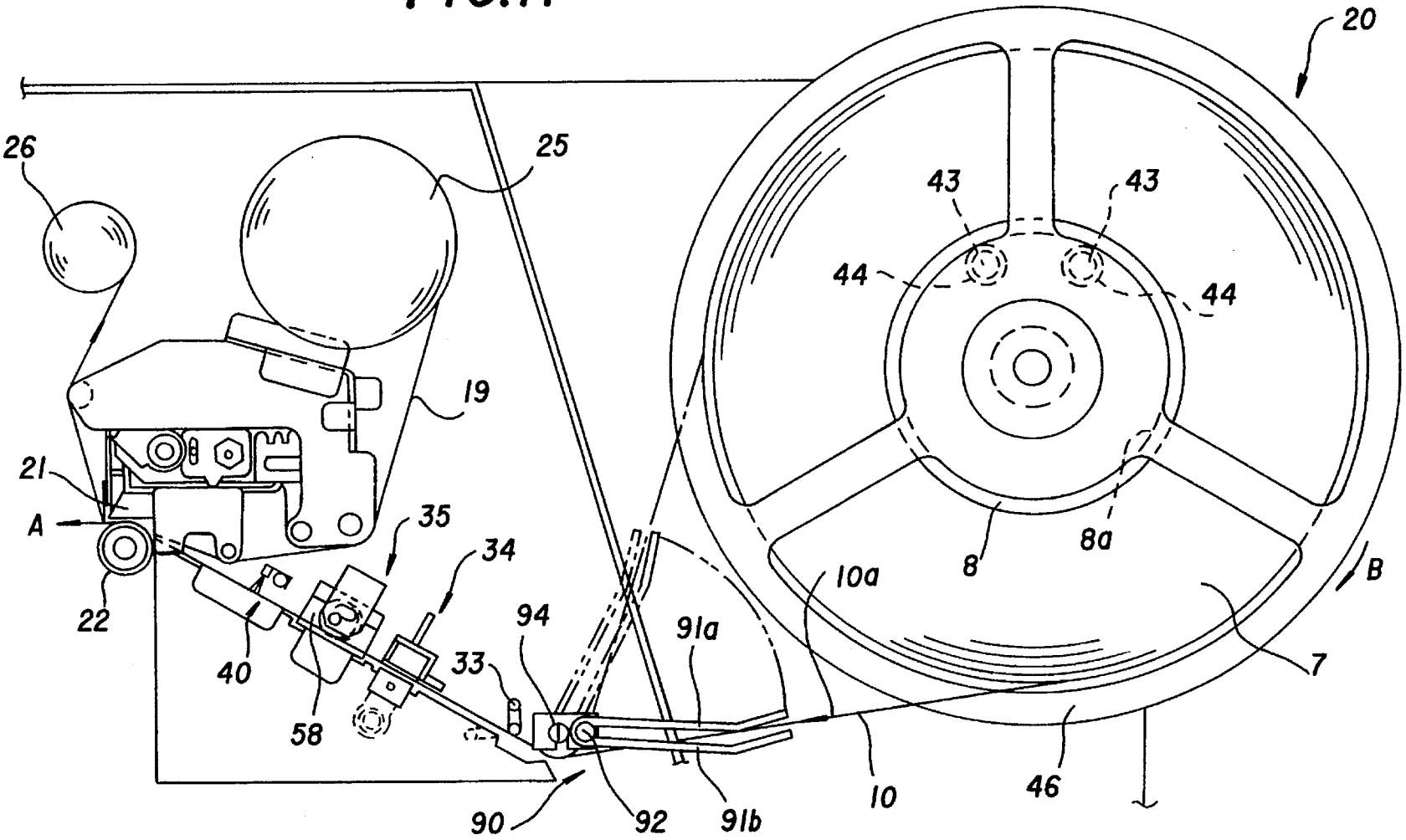
FIG. 11 is a front view showing an entire arrangement of a thermal printer according to a second embodiment of the present invention.
Figure 12:
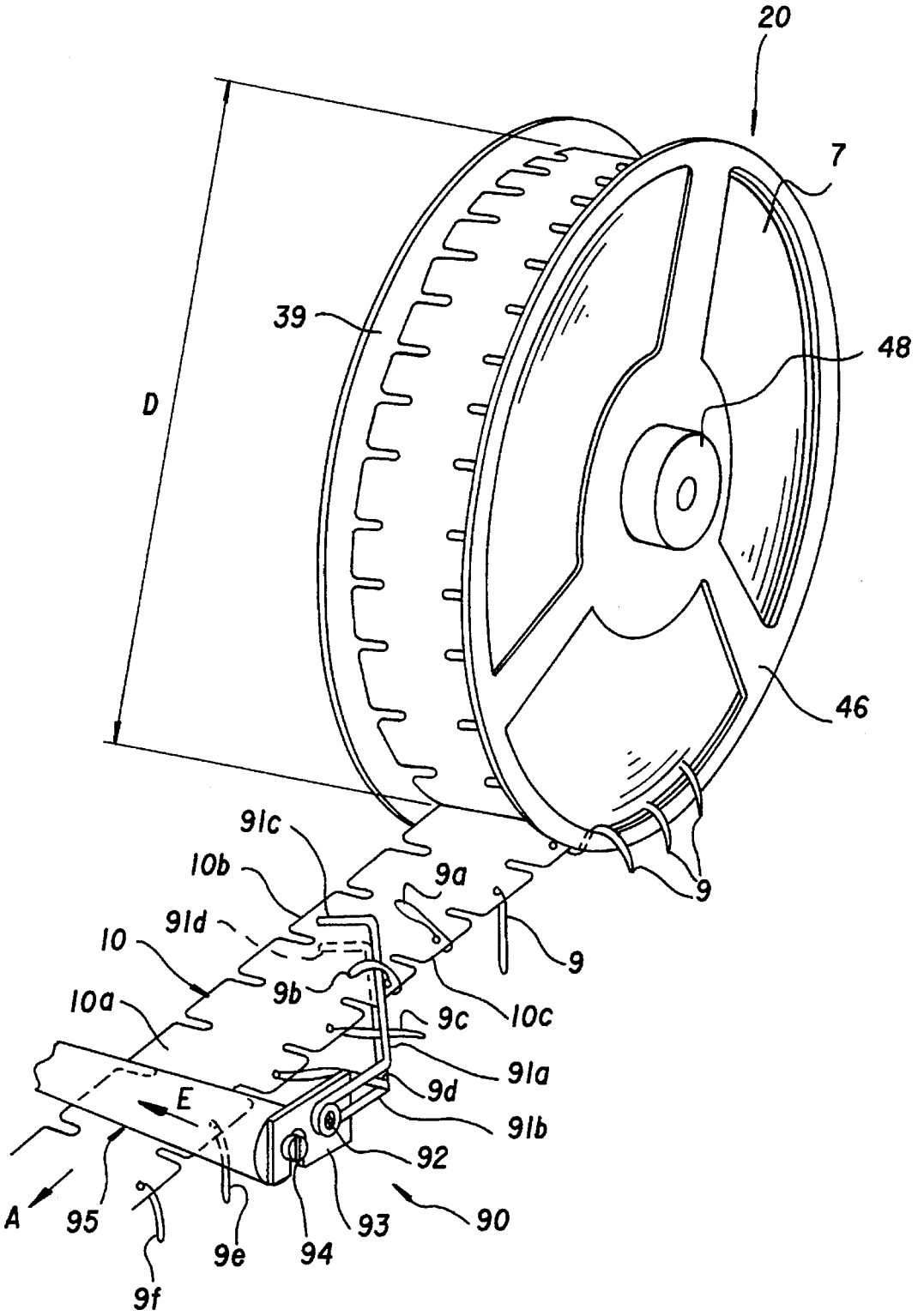
FIG. 12 is a perspective view of a first thread sweeping means and a tag roll which are respectively provided in the thermal printer of FIG. 11.
Figure 13:
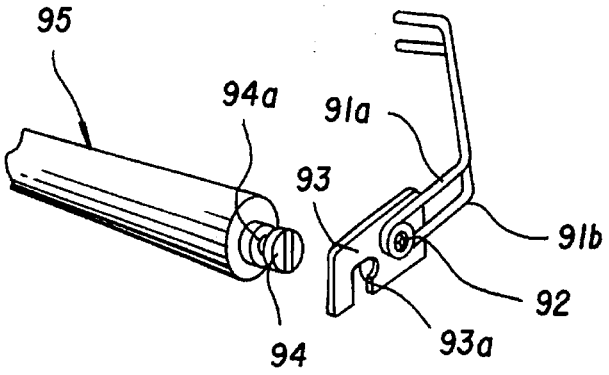
FIG. 13 is an exploded perspective view of the first thread sweeping means of FIG. 12.

Second Embodiment (FIG. 11 to 13)

A thermal printer according to a second embodiment of the invention will be described with reference to FIG. 11 to 13.

A first thread sweeping means 90 is different from that of the first embodiment and comprises a pair of confronted rod-shaped members 91*a* and 91*b* which slidably put the tag 10 therebetween at the upper and lower surfaces thereof which is drawn out from the tag roll 7 as illustrated in FIG. 11.

A pair of thread sweeping members 91*a* and 91*b* is rotatably supported on a holding member which may be in the form of an attaching plate 93 and is turnable about a screw 94 which serves as a fulcrum following the variation of the roll diameter D of the tag roll 7 as illustrated in FIG. 12 so as to sweep away the threads 9 which get on the printing surface 10*a*.

The threads sweeping members 91*a* and 91*b* are rod shaped members which are integrated with each other at the rear ends thereof which are fixed to the attached plate 93 by a screw 92 and the tip ends thereof are arranged in parallel with each other and spaced vertically at a given interval so as to put the tag 10 therebetween at the front ends thereof.

The thread sweeping members 91*a* and 91*b* are shaped when they are attached to the attaching plate 93 as illustrated in FIG. 12 in the manner of extending them in parallel with each other from the attaching plate 93 toward the front side roll presser plate 46, bending them at the portion corresponding to the side edge of the tag 10 so as to cross the tag 10 aslant, when the tag is drawn out from the tag roll 7, and further bending them at the tip portions 91*c* and 91*d* thereof in the direction remote from the tag roll 7 so that the threads 9 which get on the printing surface 10*a* are not caught by the tip portions 91*c* and 91*d*.

The attaching plate 93 to which the thread sweeping members 91*a* and 91*b* are fixedly attached has a retaining groove 93*a* (FIG. 13) which is detachably retained by an annular groove 94*a* formed on a screw 94 which if fixed to a guide roller 95. When the retaining groove 93*a* is retained by the groove 94*a*, the attaching plate 93 together with a pair of thread sweeping members 91*a* and 91*b* can turn about the screw 94 which serves as a fulcrum between the positions as illustrated in the solid and imaginary lines of FIG. 11.

The screw 94 is supported by a fixed portion, not shown, of the thermal printer and the guide roller is turnable.

The diameter of the guide roller 95 is large at one end facing the threads 9 and is tapered, i.e. gradually diminished toward the other end, thereby applying a conveying force to draw the tag 10 in the direction of the arrow E when the tag 10 is conveyed in the direction of the arrow A as illustrated in FIG. 12 so that the innermost edge surface of the tag 10 is pressed against the tag guide plate 58 as illustrated in FIG. 8 to thereby position the tag 10 at a given position.

In the second embodiment, the tag 10 is put between a pair of thread sweeping members 91*a* and 91*b* of the first thread sweeping means 90 at the upper and lower surfaces thereof after the tag is drawn out from the tag roll 7 held by the tag roll holding device 20 and is set on the conveying route as illustrated in FIG. 11.

With such an arrangement, the upper thread sweeping member 91*a* contacts the printing surface 10*a* owing to its gravity and at the same time it always contacts the upper surface of the side edge facing the threads, 9 as illustrated in FIG. 12 so that the tag 10 on which the thread as denoted at 9*a* is conveyed in the direction of the arrow A and reaches the position where it contacts the thread sweeping member 91*a*. At this position, the thread 9*a* is thrust forcibly by the thread sweeping member 91*a*, as denoted at the thread 9*b*, and is swept outside the portion where the thread sweeping member 91*a* contacts the side edge 10*c*, as denoted at the thread 9*c*.

The so-swept thread 9*c* is moved in the direction of the arrow A while it runs on the lower thread sweeping member 91*b* and is brought into contact with the attaching plate 93, as denoted at the thread 9*d*. Successively, the thread 9*d* comes off from the thread sweeping member 91*b* and hangs down as denoted at 9*e* and 9*f*, as the tag 10 keeps conveyed in the direction of the A and the hanging threads 9*c* and 9*f* are lined up at the side edge 10*c* of the tag 10 and successively conveyed to the tight holding portion defined between the thermal head 21 and the platen 22 (FIG. 11).

Accordingly, it is possible to prevent the thread 9 to be caught by the parts on the conveying route such as the tag end switch 33 or the notch detecting sensor 34, etc. and prevent the thread 9 from getting on the printing surface 10*a*, which eventually prevents the deterioration of the printing quality and also prevents the thread 9 from being passed through the tight holding portion defined between the thermal head and the platen.

Third Embodiment (FIG. 14 to 20)

A thermal printer according to a third embodiment will be described with reference to FIGS. 14 to 20 wherein elements which are the same as those in FIG. 12 are denoted by the same numerals.

The first thread sweeping means 90 is approached to the tag roll 7 as close as possible to thereby release the threads 9 from the notch 23 even if the threads 9 are caught by the notches of the tag 10. More in detail, even if one of the threads denoted as 9*g* caught by one of the notches denoted at 23 in FIGS. 15 and 16, the thread 9*g* can be released from the notch 23 by the thread sweeping member 91*a* and can be swept away from the printing surface 10*a*.

Figure 14:
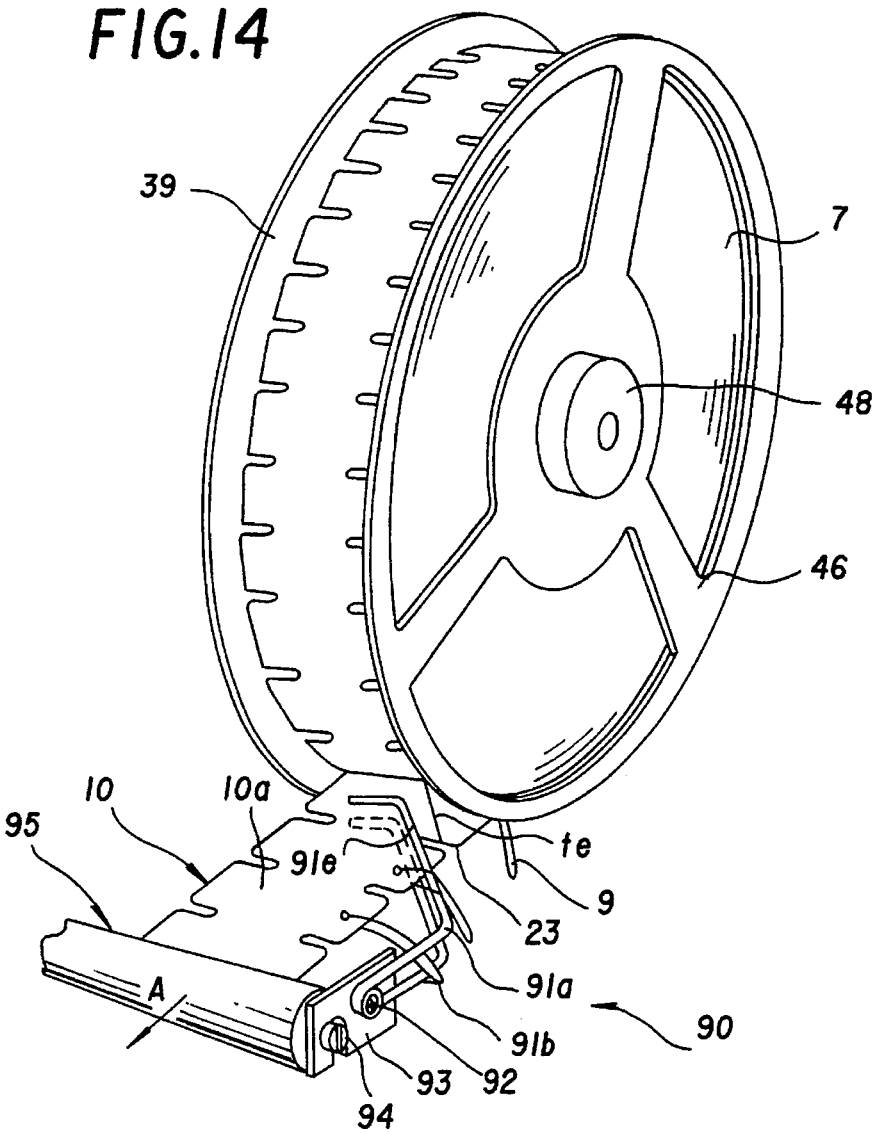
Figure 15:
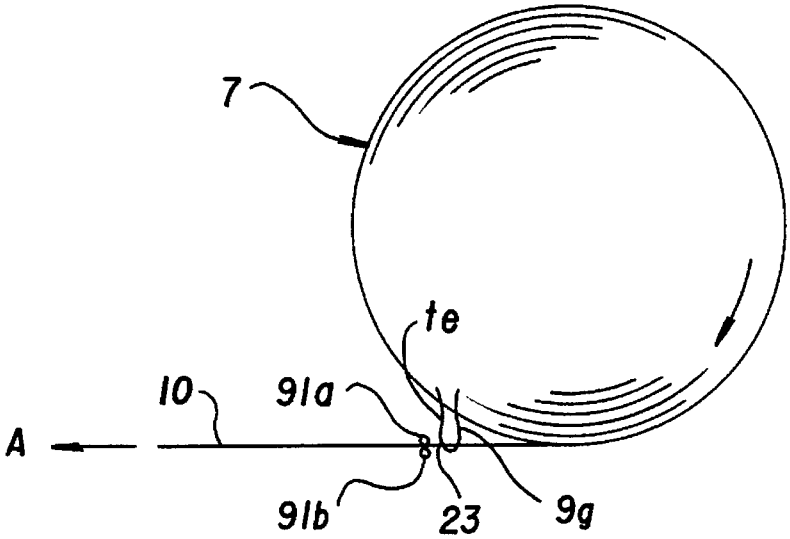
Figure 16:
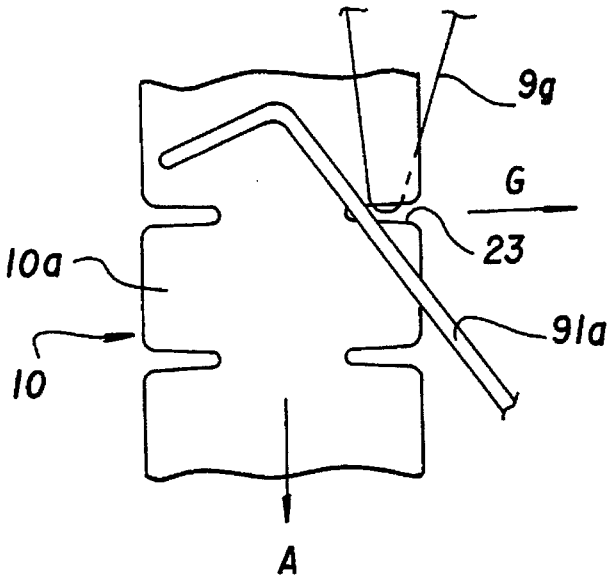

In case that the tag roll 7 is an inner winding roll type around which the tag is wound with the printing surface thereof being inside as illustrated in FIG. 14, if the thread 9*g* is caught by the notch 23 as illustrated in FIGS. 15 and 16, the thread 9*g* is stretched to thereby form an extended loop te when it is conveyed in the direction of the arrow A as illustrated in FIG. 14.

However, since the thread sweeping members 91*a* and 91*b* of the first thread sweeping means 90 are approached to the tag roll 7 as close as possible according to the third embodiment, if the extended loop te approaches an aslant portion 91*c* of the thread sweeping member 91*a* as the tag 10 is moved in the direction of the arrow A, the loop te is pushed away in the direction of the arrow G in FIG. 16. Accordingly, the thread 9*g*, which is caught by the notch 23, can be released and can be swept away from the printing surface 10*a*.

A modification of the third embodiment will be described with reference to FIG. 17 wherein components which correspond to those in FIG. 14 are denoted at the same numerals.

Figure 17:
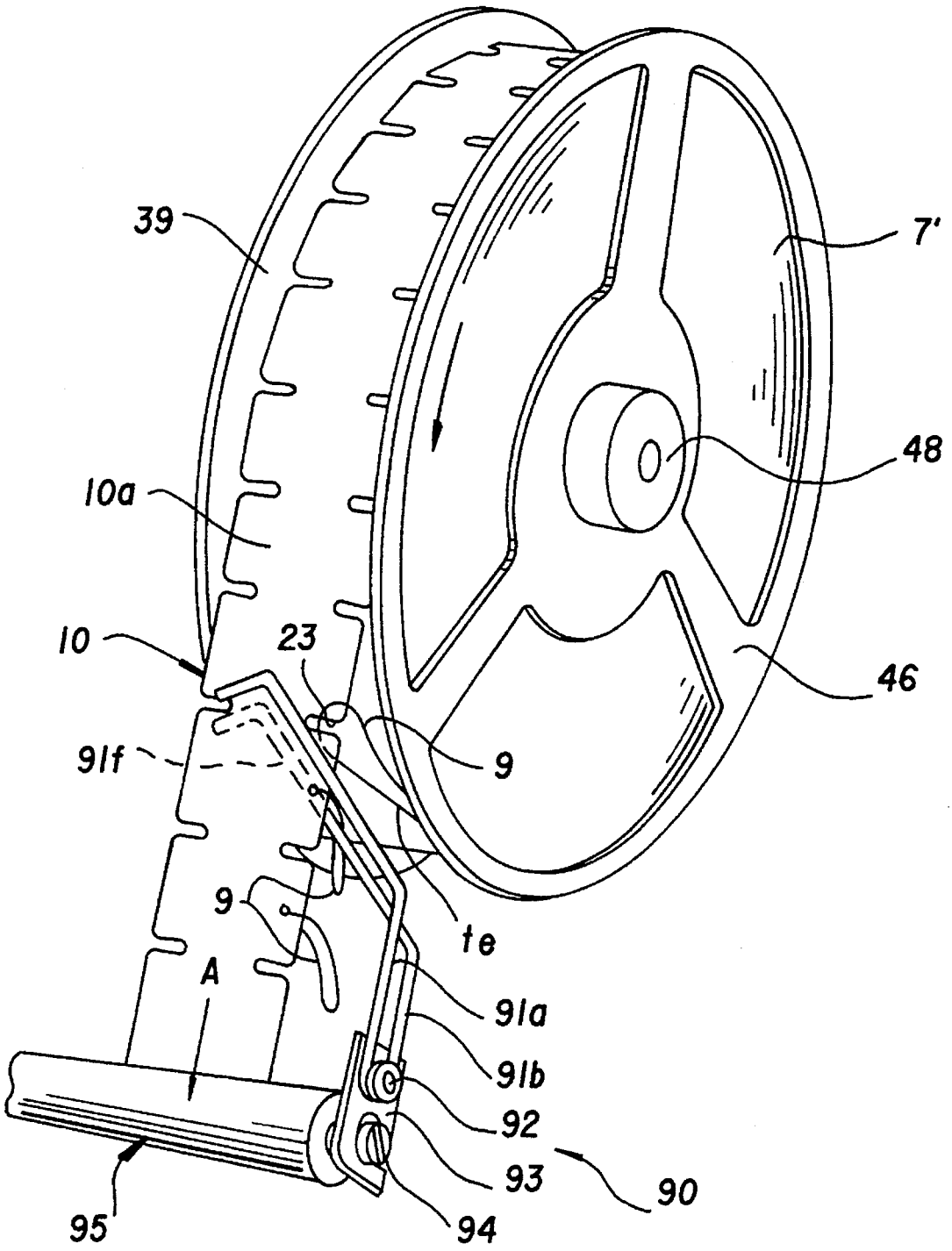

In case that a tag roll 7' is an outer winding roll type around which the tag 10 is wound with the printing surface thereof being faced outside, as illustrated in FIG. 17, if the thread is caught by the notch 23, the thread is stretched to thereby form an extended loop te as illustrated in the same figure when the tag 10 is conveyed in the direction of the arrow A.

However, since the thread sweeping members 91*a* and 91*b* of the first thread sweeping means 90 are approached to the tag roll 7' as close as possible according to this modification, if the loop te approaches to an inclined portion 91*f* of the thread sweeping member 91*a* as the tag 10 is moved in the direction of the arrow A, the loop te is pushed away from the notch 23 in the same way as explained with reference to FIG. 16.

Figure 18:
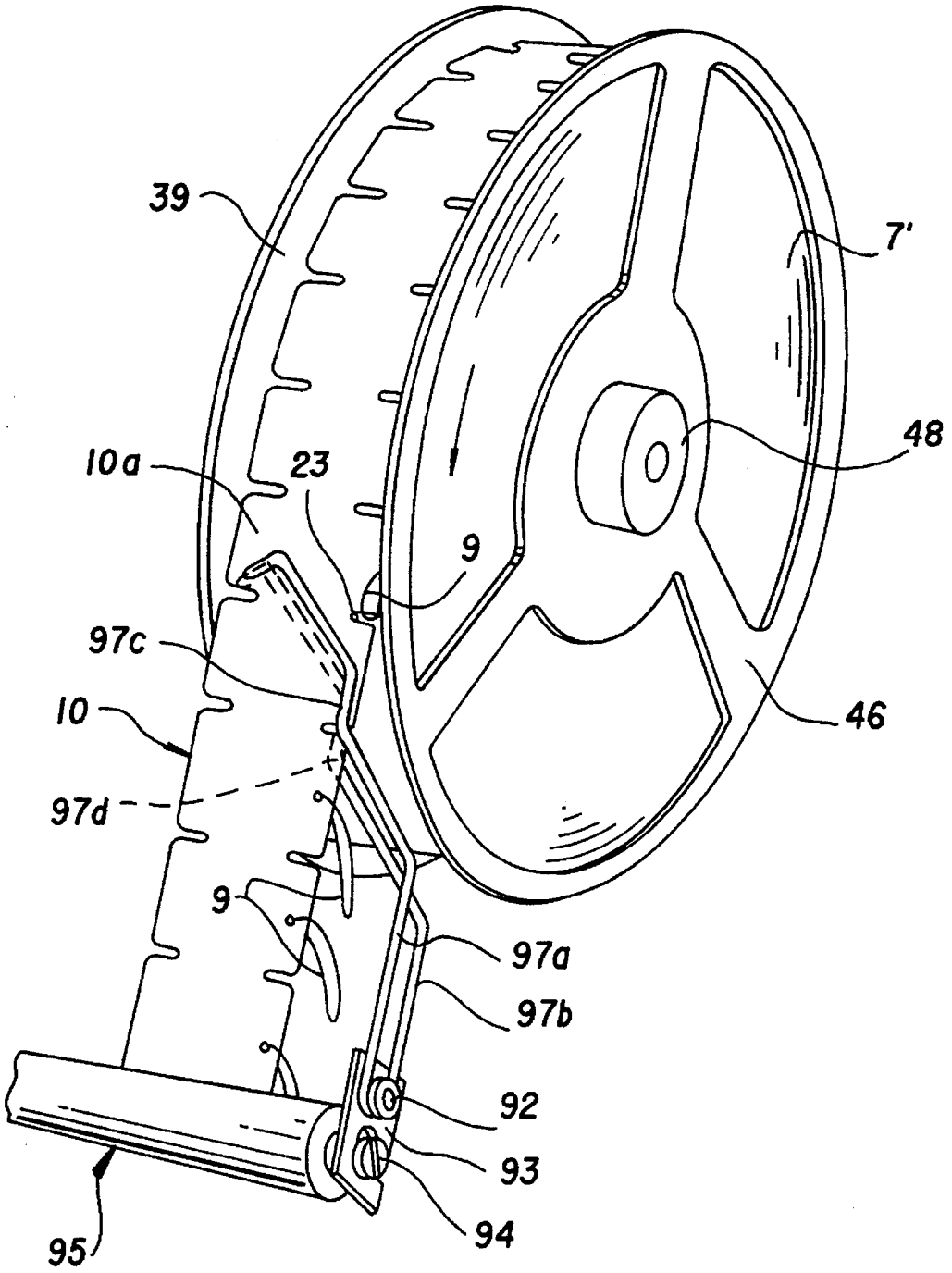
Figure 19:
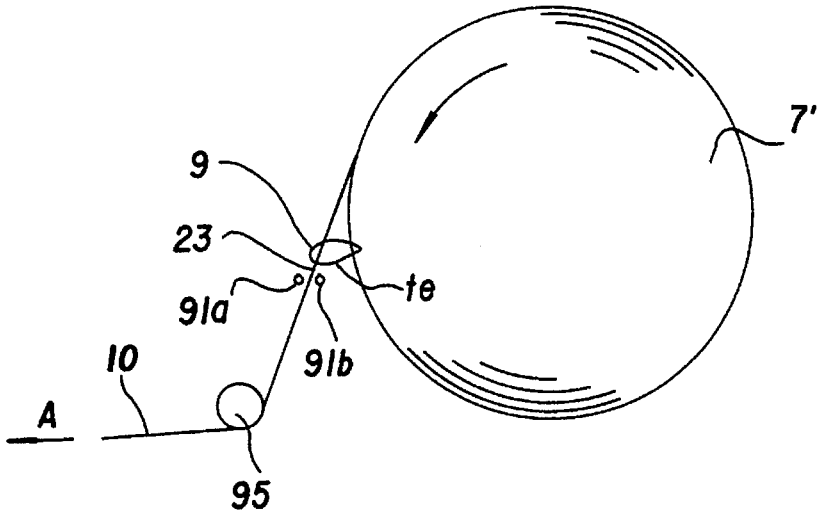

FIG. 18 is another modification of the third embodiment wherein the thread can be released from the notch of the tag even if the roll diameter of the tag roll is diminished and the components which correspond to those in FIG. 17 are denoted at the same numerals.

Different from the thread sweeping members 91*a* and 91*b* as illustrated in FIG. 17, thread sweeping members 97*a* and 97*b* have extension portions 97*c* and 97*d* formed on the middle portion thereof in the manner that the tip end portions of the thread sweeping members 97*a* and 97*b* enter the tag 10 in the direction to approach the tag roll 7' while getting away of the front side roll presser plate 46 so as to cross the tag 10 aslant.

Figure 20:
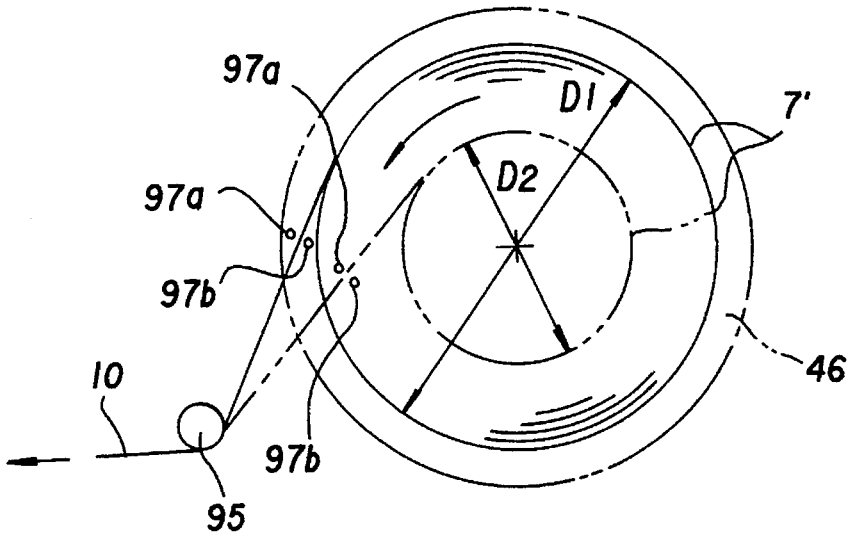
FIG. 20 is a view explaining the state where thread sweeping members of FIG. 18 can follow the tag roll even if the roll diameter of the tag roll is diminished.
Figure 21:
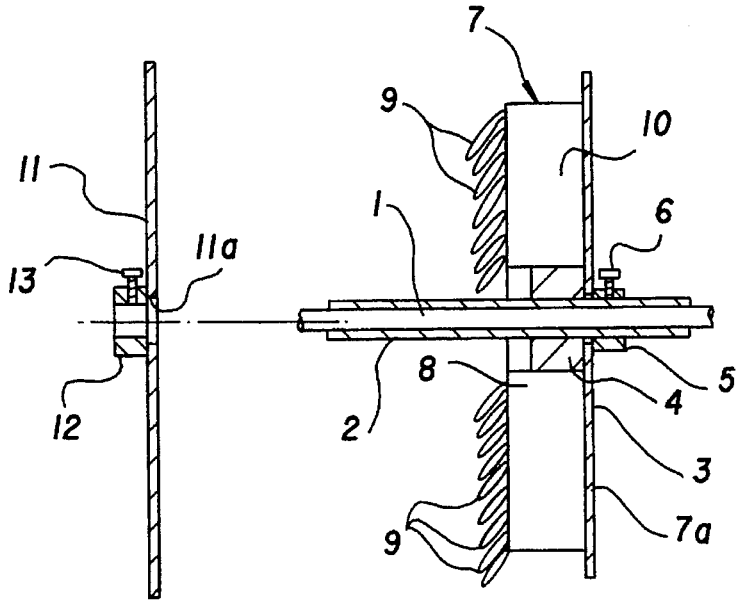
FIG.21 PRIOR ART
FIG. 21 is a longitudinal cross-sectional view of a tag roll holding device of a conventional thermal printer.
Figure 22:
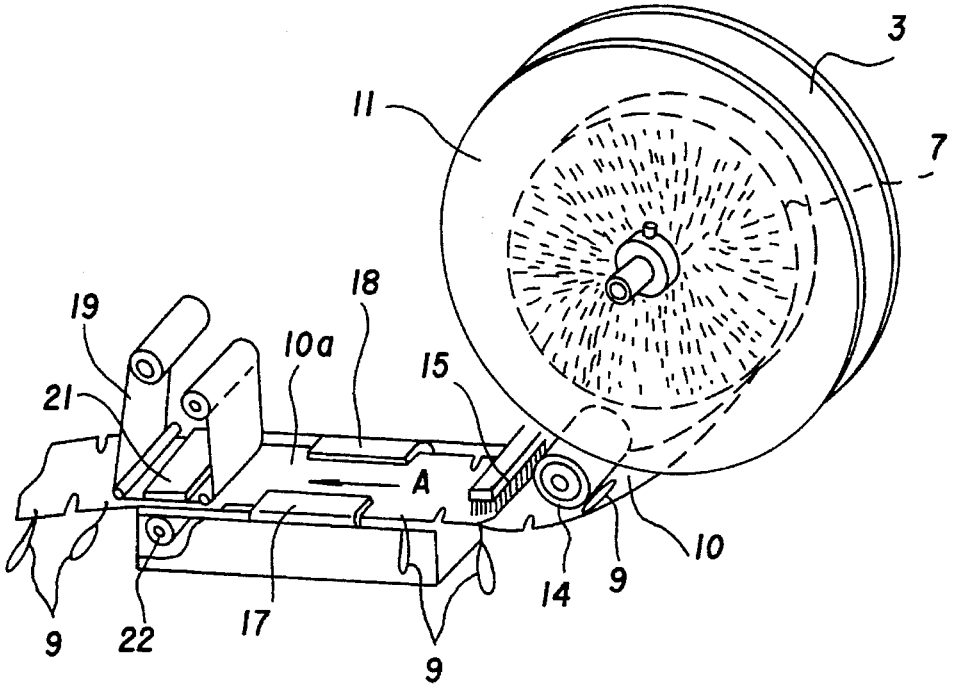
FIG.22 PRIOR ART
FIG. 22 is a perspective view of an external appearance of the thermal printer provided with the tag roll holding device of FIG. 21.

Inasmuch as the extension portions 97*c* and 97*d* are provided, the thread sweeping members 97*a* and 97*b* can release the thread from the notch 23 and sweep away the thread from the printing surface 10*a* irrespective of the roll diameter of the tag roll 7' since they can follow the tag roll 7' at the tip ends thereof owing to the extension portions 97*c* and 97*d* without interfering with the front side roll presser plate 46 even if the roll diameter of the tag roll 7' is diminished from the diameter D1 to D2 as illustrated in FIG. 20.

What is claimed is:

1. A thermal printer, comprising two roll presser plates, a tag roll containing a core and a tag having threads, the tag roll located between the two roll presser plates one of which is detachable and faces the threads attached to one edge of the tag wherein the tag is continuously wound around the outer periphery of the core of the tag roll, the tag is successively drawn out from the tag roll, and printing is performed on a printing surface of the tag while the tag is held and conveyed by a platen and a line thermal head;

the thermal printer including a roll holder which is engaged in the core of the tag roll and attached to the detachable roll presser plate for holding the entire tag roll, the detachable roll presser plate having windows through which the threads freely run off outside the roll presser plate.

2. A thermal printer according to claim 1, further comprising a supporting shaft supporting the tag roll and the two roll presser plates, and a thumb fixed to the detachable presser plate for positioning the presser plate in an axial direction of the supporting shaft.

3. A thermal printer according to claim 2, wherein the thumb is provided with a plunger, and the supporting shaft is provided with ring grooves, wherein the plunger is engageable with the ring grooves for axially positioning the presser plate on the supporting shaft.

* * * * *